US005662834A

United States Patent [19]

Schulz et al.

[11] Patent Number: 5,662,834

[45] Date of Patent: Sep. 2, 1997

[54] ALLOYS OF TI RU FE AND O AND USE THEREOF FOR THE MANUFACTURE OF CATHODES FOR THE ELECTROCHEMICAL SYNTHESIS OF SODIUM CHLORATE

[75] Inventors: Robert Schulz, Ste-Julie; André Van Neste, Ste-Foy; Sabin Boily, Montréal; Shize Jin, Ste-Foy, all of Canada

[73] Assignee: Hydro-Quebec, Montreal, Canada

[21] Appl. No.: 565,586

[22] Filed: Nov. 30, 1995

[30] Foreign Application Priority Data

Jul. 21, 1995 [CA] Canada ..... 2154428

[51] Int. Cl.[6] ..... H01B 1/08; H01B 1/02

[52] U.S. Cl. ..... 252/513; 252/514; 252/519; 252/520; 204/293; 204/298.19; 205/503; 427/496; 420/580

[58] Field of Search ..... 204/293, 298.19; 205/503, 505, 255; 420/580; 427/497, 509, 496; 252/512, 513, 514, 519, 520

[56] References Cited

U.S. PATENT DOCUMENTS

| | | | |
|---|---|---|---|
| 3,773,639 | 11/1973 | Masotti | 204/192 |
| 4,507,183 | 3/1985 | Thomas et al. | 204/98 |
| 5,112,388 | 5/1992 | Schulz et al. | 75/255 |

FOREIGN PATENT DOCUMENTS 2 088 659 1/1972 France .

OTHER PUBLICATIONS

Patent Abstracts of Japan, vol. 2, No. 110 (C–022), Sep. 13, 1978 and JP–A–53 077900, published Jul. 10, 1978.

T.A.F. Lassali, "UHV and Electrochemical Studies of the Surface Properties of Ru + Pt + Ti Mixed Oxide Electrodes," Electrochimica Acta V.39 No. 1 pp. 95–102 (Jan. 1994) Jan. 1994.

*Primary Examiner*—Kathryn Gorgos
*Assistant Examiner*—Brendan Mee
*Attorney, Agent, or Firm*—Foley & Lardner

[57] ABSTRACT

An alloy of formula:

$$Ti_{30+x}\,Ru_{15+y}\,Fe_{25+z}\,O_{30+t}\,M_u$$

wherein M represent at least one metal selected from the group consisting of chromium, manganese, vanadium, tungsten, antimony, platinum and lead; x is an integer ranging between −30 and +50; y is an integer ranging between −10 and +35; z is an integer ranging between −25 and +70; t is an integer ranging between −28 and +10; and u is an integer ranging between 0 and +50; x, y, z, t and u being selected so that: x+y+z+t+u=0. This alloy, especially when it has a nanocrystalline structure, is useful for the manufacture cathodes for the electro-chemical synthesis of sodium chlorate. These cathodes have an over-potential of hydrogen lower than the one of the soft-steel cathodes presently in use.

24 Claims, 9 Drawing Sheets

2 Ti + RuO2
GRINDING IN A
STEEL PLATE
GRINDING TIME
UNDER ARGON
40hrs

25hrs 15 hrs 5 hrs 0 hr
INTENSITY (ARBITRARY UNITS)
o = "TiRuFe" (cc)
∇ = "Ru" (hcp)
+ RuO2
× Ti (hcp)
0
10
15
20
25
30
35
40
45
2θ, MoKα

ALLOYS OF TI RU FE AND O AND USE THEREOF FOR THE MANUFACTURE OF CATHODES FOR THE ELECTROCHEMICAL SYNTHESIS OF SODIUM CHLORATE

BACKGROUND OF THE INVENTION a) Field of the Invention

The present invention relates to new nanocrystalline alloys containing Ti, Ru, Fe and O. The invention also relates to a process of preparation of these new alloys. The invention further relates to a method of producing sodium chlorate by electrochemical synthesis in an electrolysis cell having cathodes made of an alloy that has the same composition as the new alloys according to the invention, but is not necessarily of nanocrystalline structure.

b) Brief Description of the Prior Art

Sodium chlorate ($NaClO_3$) is a product used in substantial amount as a bleaching agent in the pulp and paper industry. Nearly two million of tons of sodium chlorate are produced every year in North America.

Industrially, sodium chlorate is synthesized in electrolysis cells like the one shown on FIG. 1 of the attached drawings, identified as "prior art". Each of the cells comprises a plurality of bipolar electrodes 1 extending in line between a cathode 3 consisting of soft steel plates oriented vertically at one end 5 of the cell, and an anode 7 consisting of plates titanium coated with ruthenium oxide that are oriented vertically at the other end 9 of the cell. Each of the bipolar electrode 1 comprises a cathode 11 consisting of soft steel plates 15 and an anode 13 consisting of plates 17 of titanium coated with ruthenium oxide. The plates 15 forming the cathode 11 are placed in such a way to extend between the plates acting as the anode 7 at the extremity 9 of the cell or between the plates 17 forming the anode 13 of the adjacent bipolar electrode. The junction between the cathode 11 and the anode 13 of each bipolar electrode 1 is achieved with explosion welded joints.

The chemical reaction that takes place in the cell is as follows:

$$NaCl+3H_2O \rightarrow NaClO_3+3H_2$$

Typically, the solution Contained in each cell comprises between 100 and 130 g/l of NaCl, between 580 and 660 g/l of $NaClO_3$ and between 2 and 5 g/l of $Na_2Cr_2O_7$, the latter product being used as a stabilizing agent and for maintaining a high current efficiency. The pH of the solution ranges between 5.8 and 6.8 and the temperature at which the reaction is carried out is around 70° C.

Typically also, the operating conditions at the junctions are the following:

| | |
|---|---|
| difference of potential: at the junction | 3.2 volts under a current density of 250 mA/cm$^2$ at the level of the electrodes |
| equilibrium potential: (current 0) | 2.3 volts |
| overpotential at the junction: | 900 mV |

Under these conditions, an extraction rate of sodium chlorate of about 80 g per liter of solution may be expected. Furthermore, the molecular hydrogen produced at each cathode of the cell is recycled and used for energetic purposes.

SUMMARY OF THE INVENTION

The present invention is the result of a research works carried out by the Applicant to improve the electric efficiency of the cells used for the electrochemical synthesis of sodium chlorate, whose consumption is very high (about 50 to 100 MW per plant). Any improvement reducing this important electric consumption may, at the end, amount to annual savings of many millions of dollars.

One way to achieve such an improvement of the electric efficiency of the cells is to reduce the "over potential of hydrogen" that must be added to the equilibrium potential at the surface of the cathodes in order to obtain the required hydrogen release and the simultaneous synthesis of sodium chlorate at the surface of the anodes.

In this connection, it can be understood that a reduction of the overpotential of hydrogen of 300 to 400 mV may improve the energetic efficiency of the synthesis cell by 10 to 13%.

Consequently, extensive researches have been conducted to replace the steel cathodes used until now in the industry by cathodes made of more performing materials. Thus, extensive testings have been performed with electrodes made of nickel, ruthenium, titanium, platinum, carbon and tungsten, etc. If some of these tested materials have shown some improvements over the prior art in labs industrial considerations have led most of them to be set aside for the following reasons: high price, too short lifetime of the cathodes (the soft steel cathodes presently used have a lifetime of approximately 7 years) and/or a risk of accident (especially with electrodes made of nickel because this metal catalyses the decomposition of the hypochlorite and may lead to the production of molecular oxygen and, therefore, may generate risks of explosion with the molecular hydrogen that is produced simultaneously).

The present invention is based on the discovery that the alloy of the very particular composition and structure defined hereinafter, is not only very efficient for the manufacture of cathodes for the electrochemical synthesis of sodium chlorate, but is also cheap, extremely resistant and very save to use.

OBJECTS OF THE INVENTION

The alloy according to the invention is characterized in that it has a nanocrystalline structure and is of the following formula:

$$Ti_{30+x}\,Ru_{15+y}\,Fe_{25+z}\,O_{30+t}\,M_u$$

wherein:

M represent at least one metal selected from the group consisting of chromium, manganese, vanadium, tungsten, antimony, platinum and lead, said metal M being used as a substitute for Fe and preferably consisting of chromium;

x is an integer ranging between −30 and +50, preferably between −20 and +20 and more preferably between −5 and +5;

y is an integer ranging between −10 and +35, preferably between −10 and +15 and more preferably between −5 and +5;

z is an integer ranging between −25 and +70, preferably between −25 and +25 and more preferably between −5 and +5;

t is an integer ranging between −28 and +10 and preferably between −28 and +5; and u is an integer ranging between 0 and +50, and preferably between 0 and +10;

with the proviso that x, y, z, t and u are selected so that:

x+y+z+t+u=0.

By "nanocrystalline structure", there is meant in the following description and annexed claims that the alloy is in the form of a crystalline powder whose particle or grain size is less than 100 nm and preferably less than 30 nm.

As it appears from the above formula, the nanocrystalline alloy according to the invention may comprise a given amount of one or more metals M used as catalysts, stabilizing agents and/or simply to improve the current efficiency. Preferably, the metal(s) M is (are) substituted for at least part of Fe and is (are) selected from the group consisting of Cr, Mn, V, W, Sb, Pt and Pb. The metal which is particularly preferred because its high efficiency and its low price is chromium.

The nanocrystalline alloy according to the invention can be prepared in different ways. It can be prepared from a mixture of precursor metals chosen among titanium, ruthenium, iron and the metals M, which is subjected to a mechanical grinding under an inert or oxygen-containing atmosphere. It can also be prepared from a mixture of the metals defined above and their oxides which are also subjected to a mechanical grinding under an inert or oxygen-containing atmosphere.

This process of preparation by mechanical grinding forms a second object of the present invention.

It must be understood that alloys of the same formula as defined above but not necessarily of a nanocrystalline structure may also be prepared by other techniques such as reactive cathodic spraying on a target of defined composition or by solidification of a mixture in a liquid phase, such as rapid quenching, atomization and condensation of gaseous phases, or by plasma spraying.

The nanocrystalline alloy according to the invention is in the form of a powder and may, once prepared, be compacted under cold or moderate temperature to form electrodes which can be used as cathodes for the synthesis of sodium chlorate. Such cathodes and methods that can be used for manufacturing the same, form a third object of the invention.

It is worth mentioning that this third objet of the invention is not exclusively restricted methods of manufacturing cathodes from a powder of the nanocrystalline alloy according to the invention as defined above. In fact, efficient cathodes may be prepared by methods other than the compaction of a powder, using alloys of the same composition as defined above but of a structure that is not necessarily nanocrystalline.

Thus, the invention also encompasses within its scope cathodes made of an alloy of the same formula as above but with a structure which is not nanocrystalline. Such alloy of different structure can be prepared by processes different from the one previously mentioned. Thus, for example, a powder of the alloy described above could be either projected on a substrate using a plasma spray technique or mixed with a binding agent and applied as a coating on an electrode support. It could also be applied onto the support by electro-codeposition. The powder could rather be compacted into a porous support. The coating comprising the alloy could also be applied by deposition in vapor phase (magnetron spraying technique, evaporation, etc.).

The use of such cathodes for the electrochemical synthesis of sodium chlorate forms a fourth and last object of the present invention.

In this connection, it has been discovered that cathodes made at least in part of the nanocrystalline alloy according to the invention are very stable in the electrolyte used for the synthesis sodium chlorate. They are also inert with respect to the decomposition of the hypochlorite. It has also been found that cathodes made from this alloy have an overpotential of hydrogen, measured under a current density of 250 mA/cm$^2$ at 70° C., which is approximately 300 mV lower than the steel cathodes presently used in the industry. More precisely, these cathodes have an overpotential of hydrogen of about 600 mV, as compared to 900 mV. This overpotential reduction represents a net profit of electric energy of more than 10%.

BRIEF DESCRIPTION OF THE DRAWING

The invention its advantages will be better understood upon and reading of the following, more detailed but non limitative description thereof, made with reference to the enclosed drawings in which.

GENERAL DESCRIPTION OF THE INVENTION

As mentioned hereinabove, the nanocrystalline alloy according to the invention is of formula:

$$Ti_{30+x}\ Ru_{15+y}\ Fe_{25+z}\ O_{30+t}\ M_u$$

wherein:

M is at least one metal selected from the group consisting of chrome, manganese, vanadium, tungsten, antimony, platinum, and lead, such metal being substituted at least in part for Fe and preferably consisting of chromium x is comprised between −30 and +50;

y is comprised between −10 and +35;

z is comprised between −25 and +70;

t is comprised between −28 and +10; and u is comprised between 0 and +50, x, y, z, t and u being selected so that:

x+y+z+t+u=0.

Figure 2:
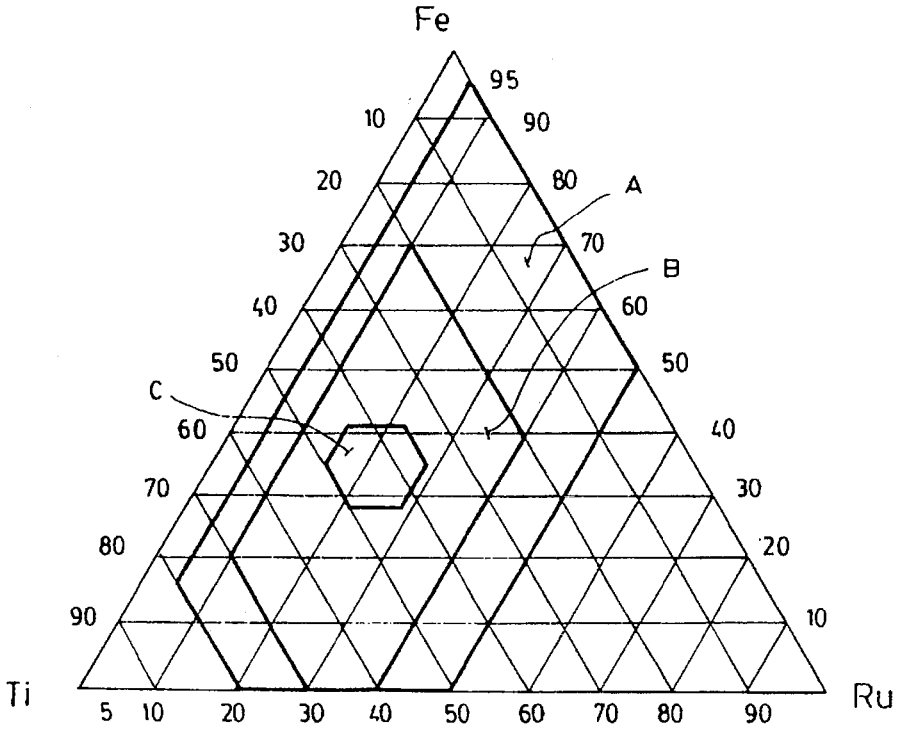
FIG. 2 is a ternary diagram showing the basic and preferred concentrations of Ti, Ru and Fe in the alloy according to the invention.

Taking apart oxygen and the metal M, this definition substantially corresponds to the largest area identified by the letter "A" on the ternary diagram shown in FIG. 2.

As readily apparent, the alloy according to the invention may exclusively consist of iron, ruthenium and oxygen (case where x=−30 and u=0). Such alloy without titanium is less stable than those containing titanium. The alloy according to the invention may also consist exclusively of titanium, ruthenium and oxygen (case where z=−25 and u =0). This nanocrystalline alloy is very good but expensive. Whatever be the value given to the integers x, y, z, t or u in the formula, the alloy must contain ruthenium. However, the amount of ruthenium should not be too high because of the expensive price of this metal and its lack of stability when it is used in an electrolyte solution.

Iron is known for its good efficiency to release hydrogen. This is why it is presently used in the industry. The compound FeTi is also known to be a good hydrogen absorbent material. Ruthenium is used as a catalyst. This is probably why the alloy of the above formula is so efficient when it is used as a cathode for the synthesis of sodium chlorate. Indeed, the dissociation of water into molecular hydrogen occurs at the cathode.

It has been found that the presence of oxygen in the alloy has very little effect on the properties of such alloy, especially when used as a cathode for the synthesis of sodium chlorate. However, the presence of oxygen is difficult to avoid unless the alloy is prepared entirely under an inert atmosphere starting from previously reduced powders.

As mentioned hereinabove, the nanocrystalline alloy according to the invention may also include a certain quantity of at least one other metal (M) as a catalyst, a stabilizing agent and/or simply to improve the current efficiency. As such, the alloy may comprise up to 50% at chromium. This addition could reduce substantially or even eliminate the use of $Na_2Cr_2O_7$ as an additive in the electrolyte solution, whose purpose is essentially to increase the yield of synthesis by reducing the risks of chlorate decomposition. Other metals which might possibly be used as additives in the alloy according to the invention are manganese, vanadium, tungsten, antimony, platinum and lead.

According to a first preferred embodiment of the invention, x, y, z, t and u are selected as follows:

x is ranging between −20 and +20;

y is ranging between −10 and +15;

z is ranging between −25 and +25;

t is ranging between −28 and +5; and u is ranging between 0 and +10.

Taking apart oxygen the metal M, this first preferred embodiment corresponds essentially to the area identified by the letter "B" on the ternary diagram illustrated on FIG. 2.

According to a second preferred embodiment of the invention, x, y, z, t and u are selected as follows:

x is ranging between −5 and +5;

y is ranging between −5 and +5;

z is ranging between −5 and +5;

t is ranging between −28 and +5; and u is ranging between 0 and +10.

Taking apart oxygen and the metal M, this second preferred embodiment corresponds essentially to the area identified by the letter "C" on the ternary diagram illustrated on FIG. 2. The alloys according to this second preferred embodiment are those which seem to offer the best commercial possibilities, if one takes into account their price, their resistance and their electric efficiency when they are used as cathodes for the synthesis of chlorate.

The alloy according to the invention is defined in the product claims attached hereto as having a nanocrystalline structure. In fact, this micro-structure is favorable for the reduction of the overpotential of hydrogen when the alloy is used as a cathode for the synthesis of sodium chlorate.

However, the invention is not exclusively restricted to the use of such a nanocrystalline alloy. As a matter of fact, it has been discovered that alloys of a conventional polycrystalline structure and of the same formula as defined hereinabove, also have the advantage of reducing the overpotential of hydrogen when they are used as cathodes for the synthesis of sodium chlorate.

To produce the nanocrystalline alloy according to the invention, a mixture of precursor metals chosen from the group composed of titanium, ruthenium and iron are mechanically grounded in an inert or oxygen-containing atmosphere. Alternatively, a mixture of these metals or their oxides can be mechanically ground in an inert atmosphere (such as argon) or an oxygen-containing atmosphere. The duration of this grinding step is extremely variable and depends essentially upon the kind of alloy that is desired. This duration is generally comprised between 20 and 50 hours.

This process of preparation by mechanical grinding constitutes one of the objects of the invention. To obtain the desired powder of nanocrystalline structure, the mechanical grinding has to be intense, in order not only to produce the alloy that is desired but also to reduce the size of the crystals that are produced to the desired value e.g. until a maximum of a few tens of nanometer. To do so, a high energy ball milling machine with or without rotatory movement of the plate, or a grinder can be used. As examples of such machines or grinders, reference can be made to those grinders sold under the trade marks SPEX 8000 or FRITCH or to the milling machine sold by ZOZ GmbH.

As an example of synthesis, a mixture of powders of Ti and of $RuO_2$ in a proportion of two atoms of Ti for one molecule of $RuO_2$ has been prepared. This corresponds to the following starting formula: $Ti_{40}Ru_{20}O_{40}$. This mixture was placed in a steel plate with steel balls and ground during 40 hours. During such grinding, the powders interreacted. The ruthenium oxide and titanium were transformed into a new structure which is similar to the one of an intermetallic mix of TiRu and hexagonal Ru.

All along the grind process, the crystalline structure improved. The crystals became smaller and smaller and some iron coming from the abrasion of the plate was slowly incorporated into the material. It is important to specify that the amount of iron and its rate of incorporation into the alloy may be controlled very precisely after a few experiments. It is also important to specify that the iron may voluntarily be added at the beginning of the milling. In fact, the nature of the powders and the initial composition of the mixture that is used have a great influence on the rate of abrasion of the plate.

After typically thirty hours or so of grinding, a fine nanocrystalline powder (e.g. with grain size in the range of a few nanometers) was formed. This powder had the following composition: $Ti_{30.4}\ Ru_{15.9}\ Fe_{23.3}\ O_{30.4}$.

Figures 4A, 4B, 4C, 4D, 4E:
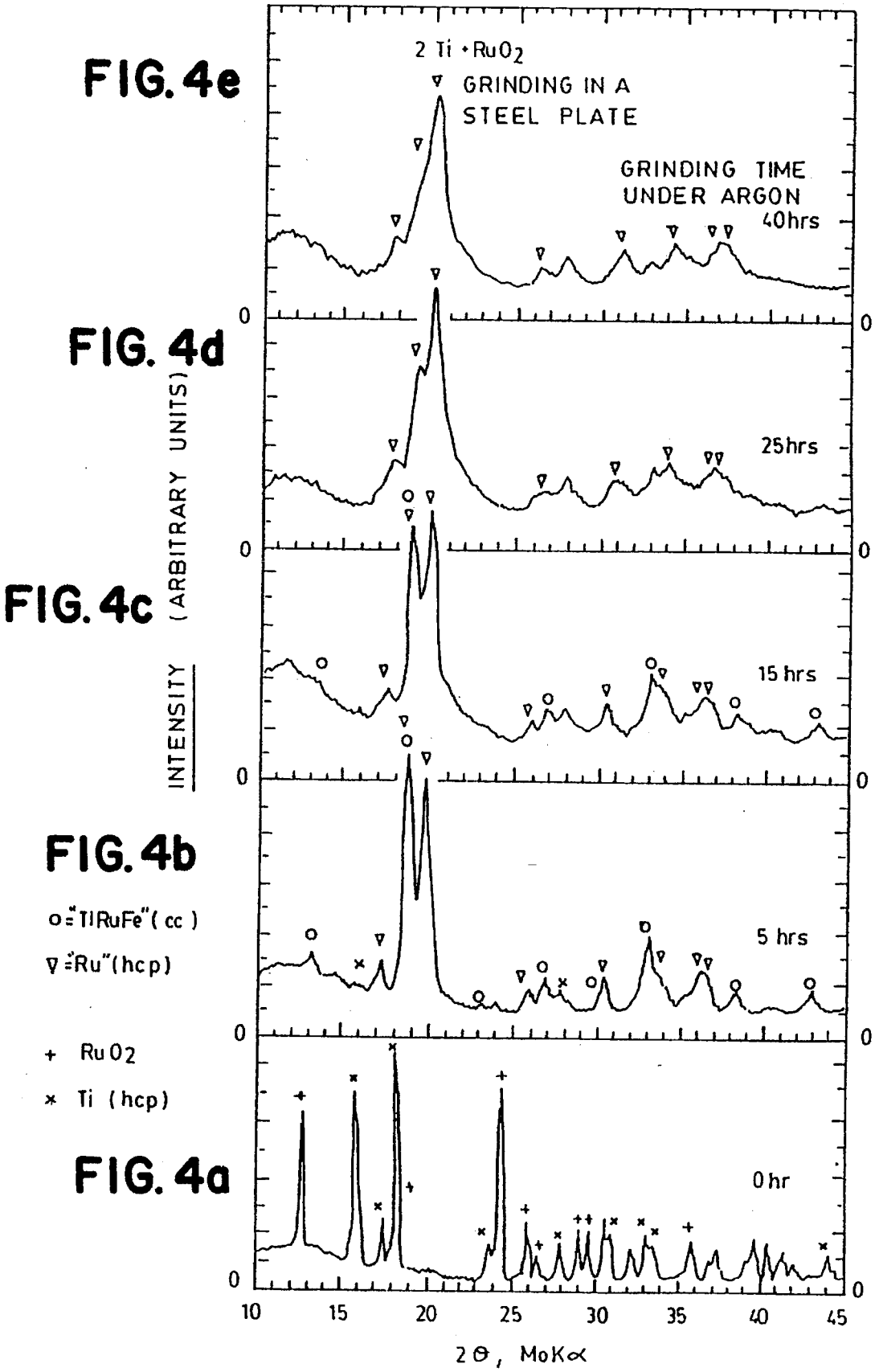
FIGS. 4 are X-ray diffraction spectra of a mixture of Ti and $RuO_2$ ground in a high energy ball milling machine; as a function of time.

The evolution of the X-ray diffraction spectra of the initial mixture and the powders formed all along the grinding process is shown on FIG. 4.

Proceeding in the same way as previously disclosed with a grinder having either a steel plate or a tungsten carbide plate for a griding of about 40 hours, many other alloys according to the invention were prepared. The metals or oxides used as starting materials and the formula of the alloys that were so prepared are given in Table 1 hereunder.

In this Table 1, each alloy has been given a number. The "corresponding position" of each of the numbered alloys in the ternary diagram illustrated in FIG. 2 is given in FIG. 3.

Figure 5:
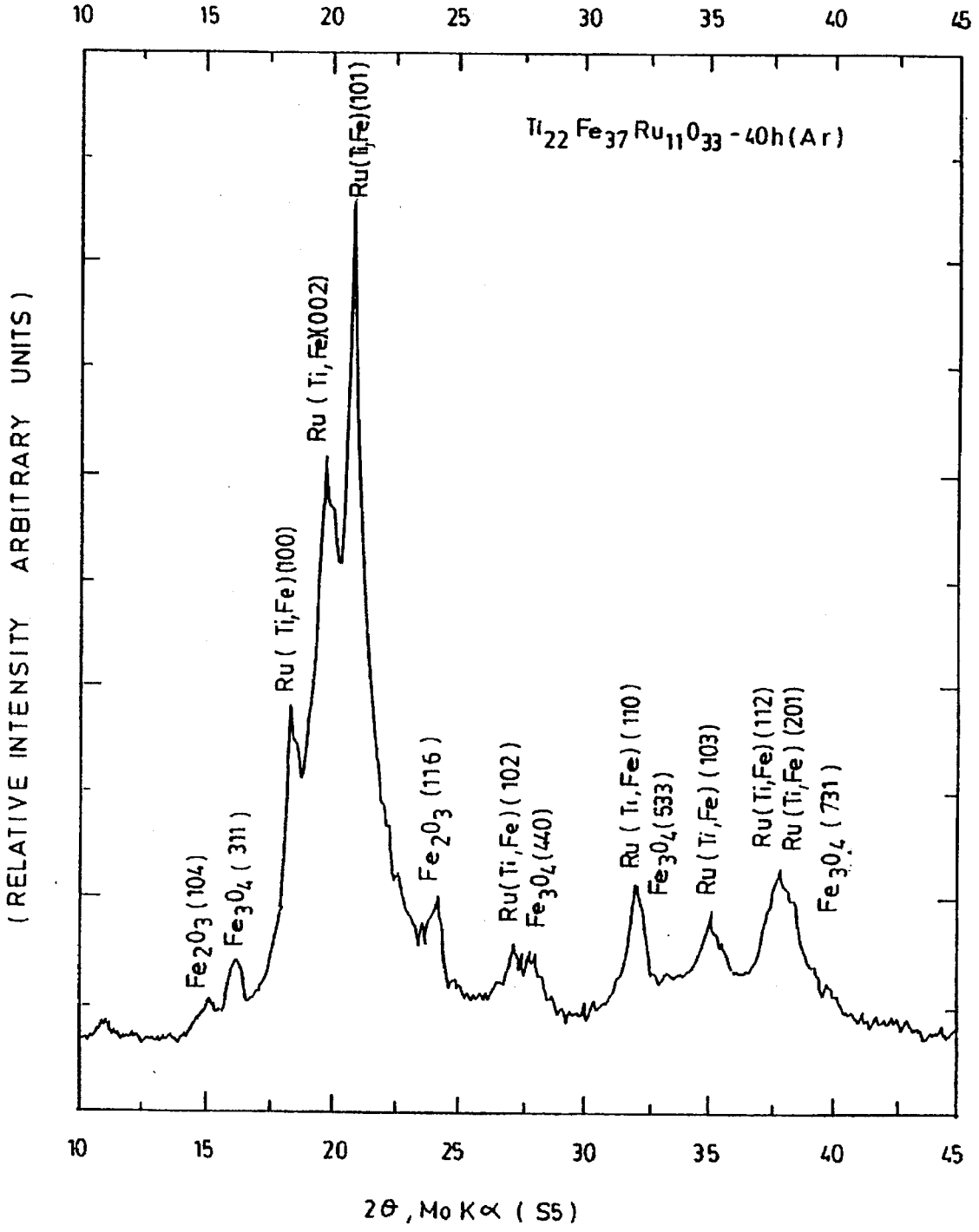
FIG. 5 is a X-ray diffraction spectrum of the alloy of formula $Ti_{22}$ $Ru_1$ $Fe_{37}$ $O_{33}$ according to the invention, as obtained after 40 hours of grinding.
Figure 6:
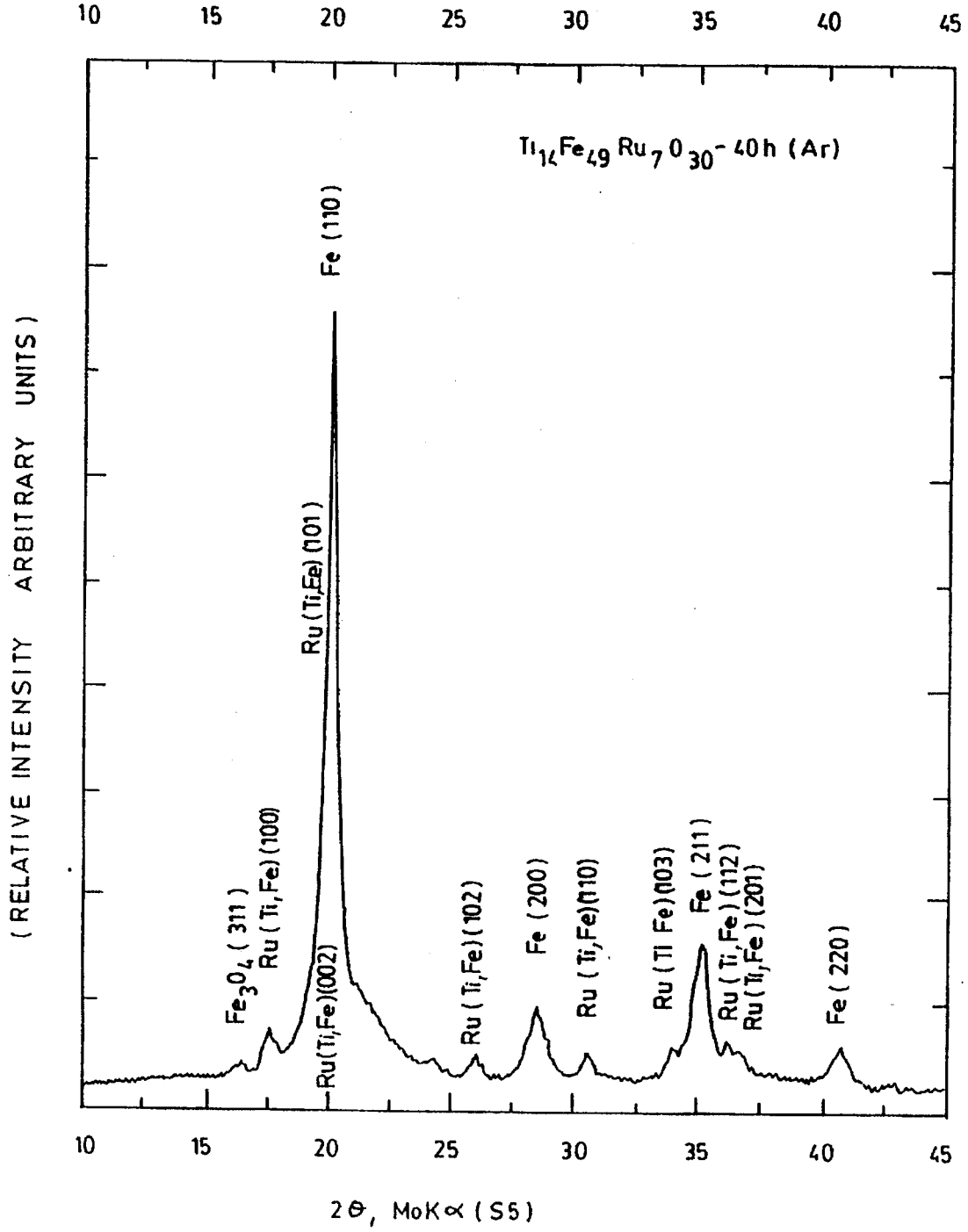
FIG. 6 is a X-ray diffraction spectrum of the alloy of formula $Ti_{14}$ $Ru_7$ $Fe_{49}$ $O_{30}$ according to the invention, as obtained after 40 hours of grinding.

The X-ray diffraction spectra of alloys numbered 33 and 34 in Table 1 are given on FIGS. 5 and 6, respectively, for information.

TABLE 1

| | | | |
|---|---|---|---|
| 8 | Fe + Ru | steel → | $Fe_{75}Ru_{25}$ (Air) |
| 9 | Fe + Ru | steel → | $Fe_{85}Ru_{15}$ (Air) |
| 10 | Fe + Ru | steel → | $Fe_{75}Ru_{25}$ (Air) |
| 11 | Fe + Ru | steel → | $Fe_{52.5}Ru_{17.5}O_{30}$ |
| 12 | Ti + $RuO_2$ | steel → | $Ti_{40}Ru_{20}O_{40}$ + Fe (25% wt) |
| 16 | Ti + Ru + $RuO_2$(grad) + TiO(grad) | WC → | $Ti_{48}Ru_{24}O_{28}$ |
| 17 | Ti + $RuO_2$(grad) | WC → | $Ti_{40}Ru_{20}O_{40}$ |
| 18 | Ti + $RuO_2$(grad) + Fe(25% wt) | WC → | $Ti_{32}Fe_{20}Ru_{16}O_{32}$ |
| 19 | Ti + Ru + $Fe_2O_3$ | WC → | $Ti_{32}Fe_{20}Ru_{16}O_{32}$ |
| 20 | Ti + Fe + TiO + $Fe_2O_3$ | steel → | $Ti_{50}Fe_{25}O_{25}(Ti_2FeO)$ |
| 21 | Ti + $Fe_2O_3$ | steel → | $Ti_{45}Fe_{22}O_{33}(Ti_2FeO_{1.5})$ |
| 22 | Ti + TiO + $Fe_2O_3$ | steel → | $Ti_{40}Fe_{20}O_{40}(Ti_2FeO_2)$ |
| 23 | Ti + Fe + Ru + TiO + $Fe_2O_3$ | WC → | $Ti_{20}Fe_{32}Ru_{16}O_{32}$ |
| 24 | Ti + Ru + $Fe_2O_3$ | WC → | $Ti_{40}Fe_{20}Ru_{10}O_{30}$ |
| 25 | Ti Fiber + powder of alloy n° 12 | | |
| 26 | Ti + Fe + Ru + TiO + $FeO_3$ | WC → | $Ti_{28}Fe_{30}Ru_{14}O_{28}$ |
| 28 | Ti + Fe + Ru + TiO + $Fe_2O_3$ | WC → | $Ti_{37}Fe_{15}Ru_{16}O_{32}$ |
| 29 | Ti + Ru + TiO + $FeO_3$ | WC → | $Ti_{42}Fe_{10}Ru_{16}O_{32}$ |
| 30 | Ti + Fe + Ru + TiO + $Fe_2O_3$ | WC → | $Ti_{47}Fe_5Ru_{16}O_{32}$ |
| 31 | Ti + Fe + Ru + TiO + $Fe_2O_3$ | WC → | $Ti_{10}Fe_{42}Ru_{16}O_{32}$ |
| 32 | Ti + Fe + Ru + TiO + $Fe_2O_3$ | WC → | $Ti_{42}Fe_7Ru_{21}O_{30}$ |
| 33 | Ti + Fe + Ru + $Fe_2O_3$ | WC → | $Ti_{22}Fe_{37}Ru_{11}O_{30}$ |
| 34 | Ti + Fe + Ru + $Fe_2O_3$ | WC → | $Ti_{14}Fe_{49}Ru_7O_{30}$ |
| 35 | Ti + Fe + Ru + $Fe_2O_3$ | WC → | $Ti_8Fe_{58}Ru_4O_{30}$ |

It is worth mentioning that the alloy of the above mentioned formula may also be prepared by other techniques such as reactive cathodic spraying on a target of appropriate composition or again by solidification of a liquid has achieved by rapid quenching, atomization or condensation of gaseous phases, or by plasma spraying. In such a case, the alloys that are so-obtained does not necessarily have a nanocrystalline structure.

The alloy of the above mentioned formula, whatever be its structure, is, once prepared, in the form of a powder or a coating. The powder may be compacted under cold or moderate temperature to form electrodes which may be used as cathodes for synthesis of sodium chlorate.

Such cathodes may also be prepared by many other methods. The powder can be inserted into a porous support. It can be plasma sprayed onto a substrate or mixed to a binding agent and applied as a coating onto an electrode support. The coating can also be made by deposition of a vapor phase (magnetron spraying, evaporation, etc.).

During the researches having led to the present invention, it has been discovered that the cathodes made from alloys of the above mentioned formula are very stable in the electrolyte used for the synthesis of sodium chlorate, and inert relative to the decomposition of the hypochlorite. It has also been found that the cathodes made from this alloy have an overpotential of hydrogen lower than the steel cathodes presently used in the industry. This reduction in the overpotential of hydrogen is more important when the alloy has a nanocrystalline structure. When measured under a current of density of 250 mA/cm$^2$ at 70° C. in an electrolyte cell, these overpotential of hydrogen is approximately 300 mV lower than the one of the steel cathodes. The latter have an overpotential of hydrogen equal to approximately 900 mV while the cathodes made from the alloys according to the invention have an over potential of hydrogen equal to about 600 mV. When multiplied by the number of cathodes and the number of cells in a sodium chlorate production plant, this reduction in the overpotential of hydrogen represents a net gain of electric energy of more than 10%.

Figure 3:
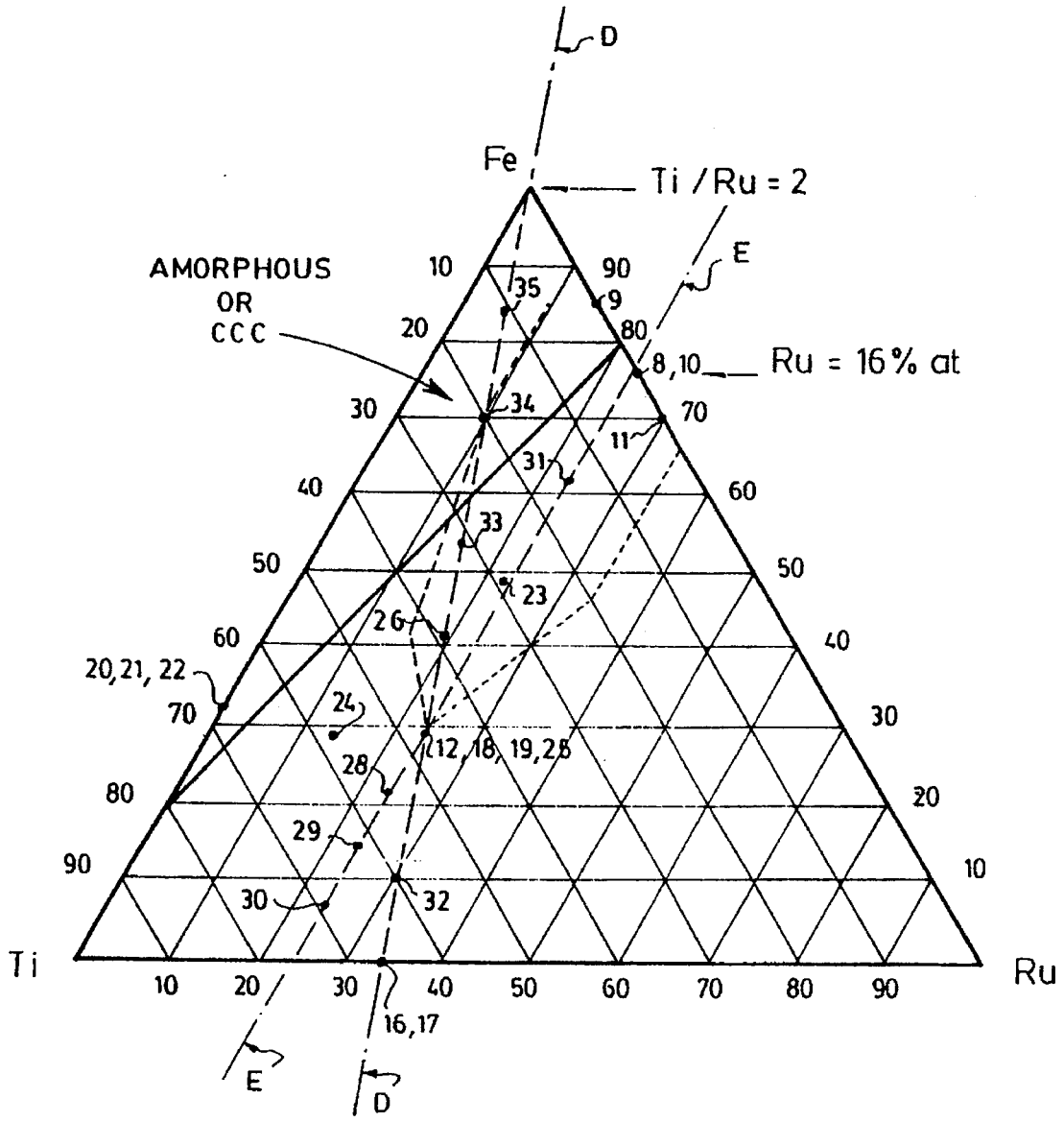
FIG. 3 is a ternary diagram identical to the one of FIG. 2, showing the respective concentrations of Ti, Ru and Fe in the alloys according to the invention which have been prepared and thoroughly tested.
Figure 7:
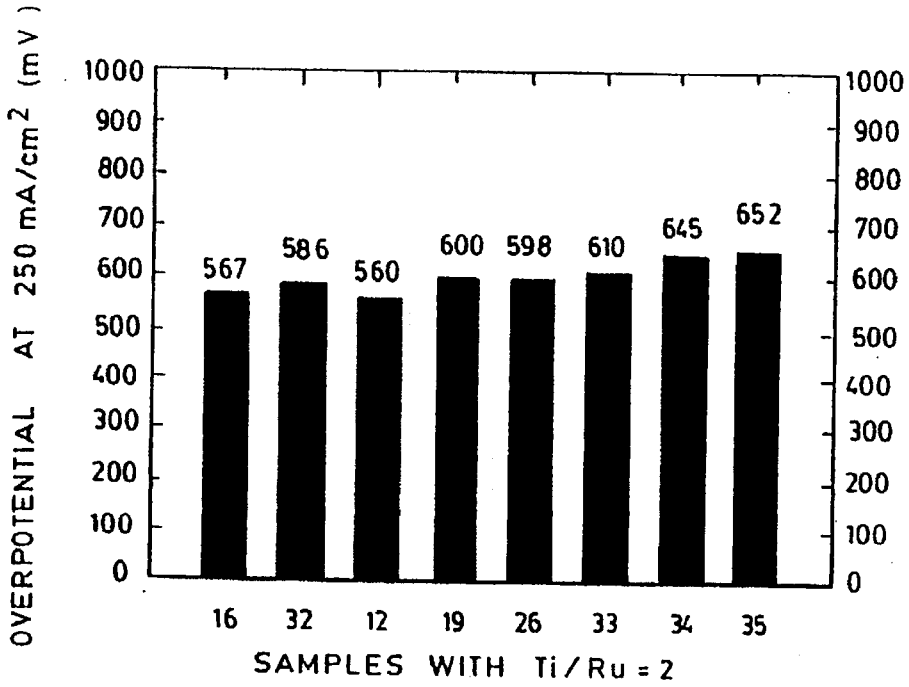
FIGS. 7 and 8 are diagrams showing the value of the overpotential measured on cathodes prepared from the alloys identified on FIG. 3, under a current density of 250 mA/cm$^2$.
Figure 8:
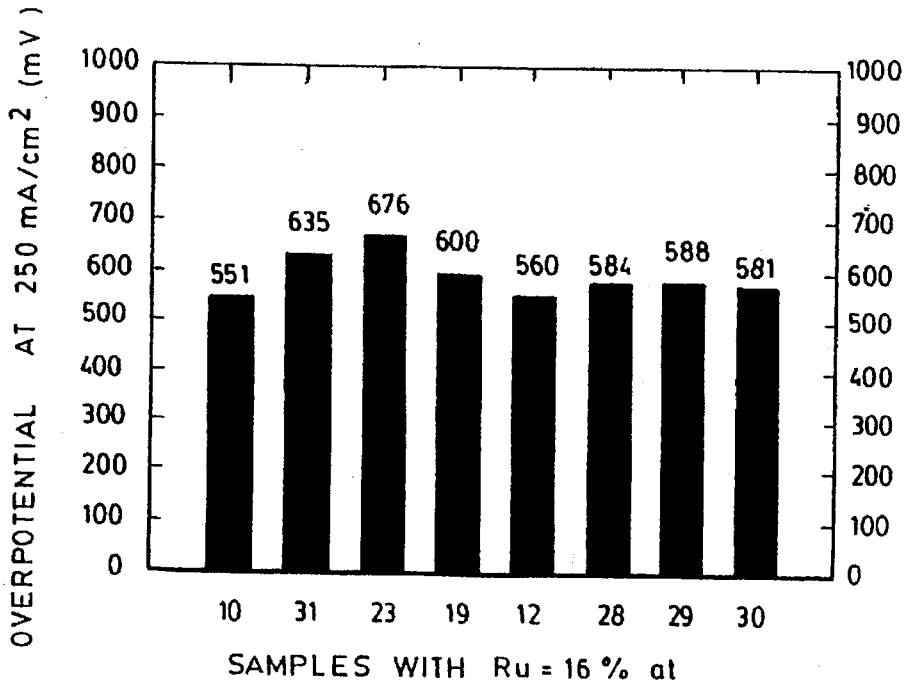

FIGS. 7 and 8 of the drawings give the value of the overpotential of hydrogen measured on a plurality of nanocrystalline alloys according to the invention, identified in Table 1 and on FIG. 3. The alloys whose overpotentials of hydrogen are given on FIG. 7 have a Ti/Ru atomic ratio equal to 2. These alloys are aligned on the line DD illustrated on FIG. 3. The alloys whose overpotentials of hydrogen are given on FIG. 8 are alloys whose atomic percentage of Ru is about 16%. These alloys are aligned on the line EE illustrated on FIG. 3.

As previously mentioned, this reduction in the overpotential of hydrogen is achieved even if the alloy used to make the cathode does not have a nanocrystalline structure. For example, a nanocrystalline alloy was prepared by mechanical grinding according to the invention. This alloy comprised:

49.0 at. % of Ti 24.5 at. % of Ru 26.6 at. % of Fe

The overpotential measured after 60 minutes under a current density of 250 mA/cm$^2$ on a cathode made from this alloy, was 619 mV.

Then, an alloy was prepared by fusion in an arc furnace. This alloy comprised:

49.9 at. % of Ti 25.1 at. % of Ru 25.0 at. % of Fe

The overpotential measured after 10 minutes under a current density of 250 mA/cm$^2$ on a cathode made from this melted alloy of formula similar to the previous one but not having a nanocrystalline structure, was 850 mV.

In both cases, there was a reduction in the overpotential of hydrogen. However, this reduction was more important on the cathode made of a nanocrystalline alloy.

Figure 10:
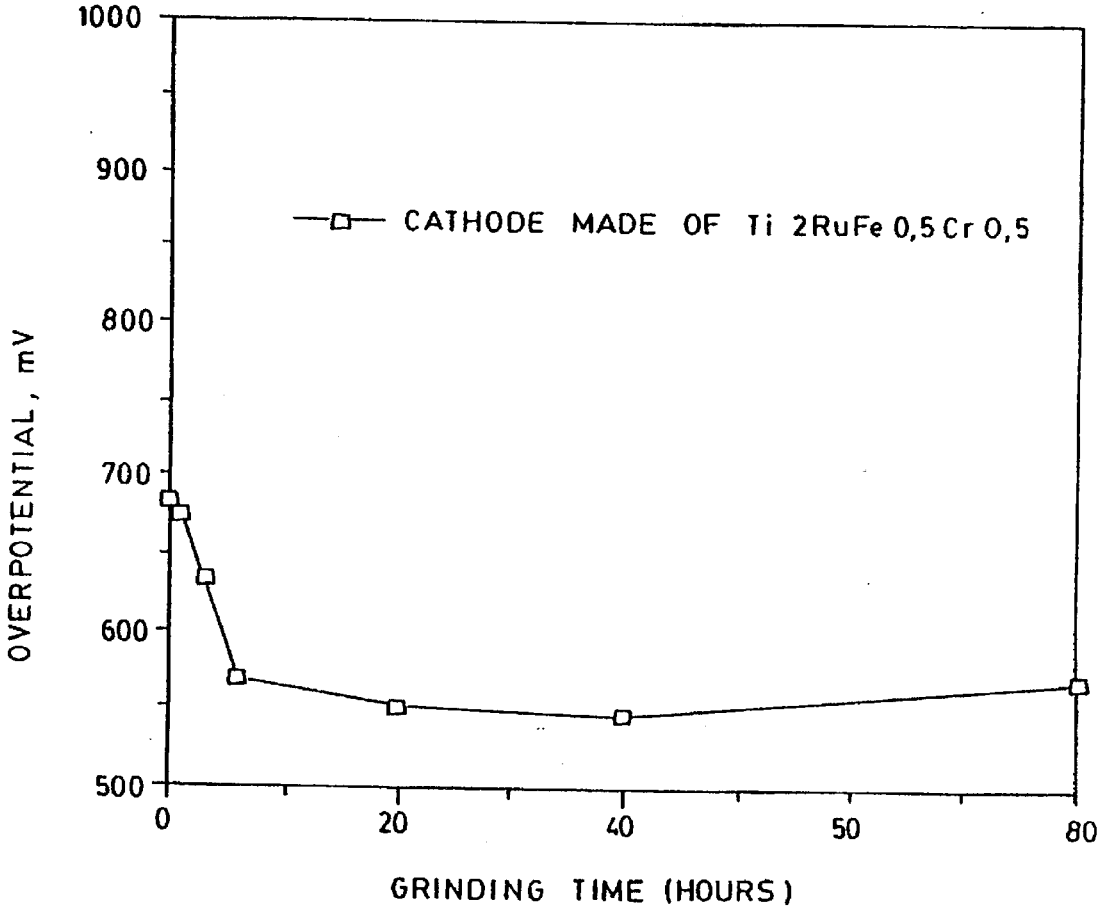
FIGS. 10 and 11 are diagrams giving the values of the overpotential of hydrogen measured with alloys wherein 50% and 100% of Fe have been substituted by chromium, as a function of the crushing time.
Figure 11:
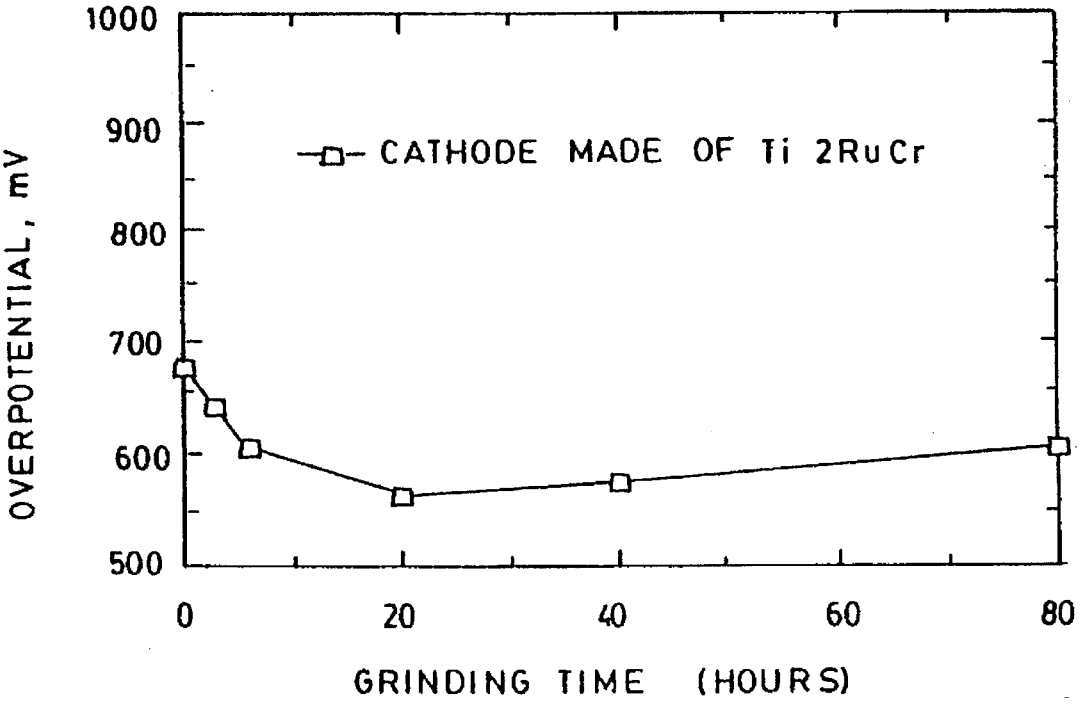

FIGS. 10 and 11 show the values of overpotential of hydrogen measured under a current density of 250 mA/cm$^2$ on cathodes made from alloys according to the invention wherein Fe was partially or totally replaced by Cr, as a function of the grinding time. As it appears, the overpotential of hydrogen measured on these alloys is relatively low (less than 700 mV), even when the alloys have not been grounded yet. This over potential drop even more as soon as the alloys are crushed, to reach a plateau after approximately 20 hours of grinding. With the alloy illustrated in FIG. 10, the overpotential after 20 hours of grinding was 552 mV. Concerning the alloy illustrated on FIG. 11, the over potential after 20 hours of grinding was 560 mV.

In all cases, it is worth mentioning that the overpotential of hydrogen is clearly lower than the 900 mV value generally measured on the steel cathodes presently used in the industry. It is also worth noting that this overpotential is even lower when the alloy has a nanocrystalline structure.

Figure 1:
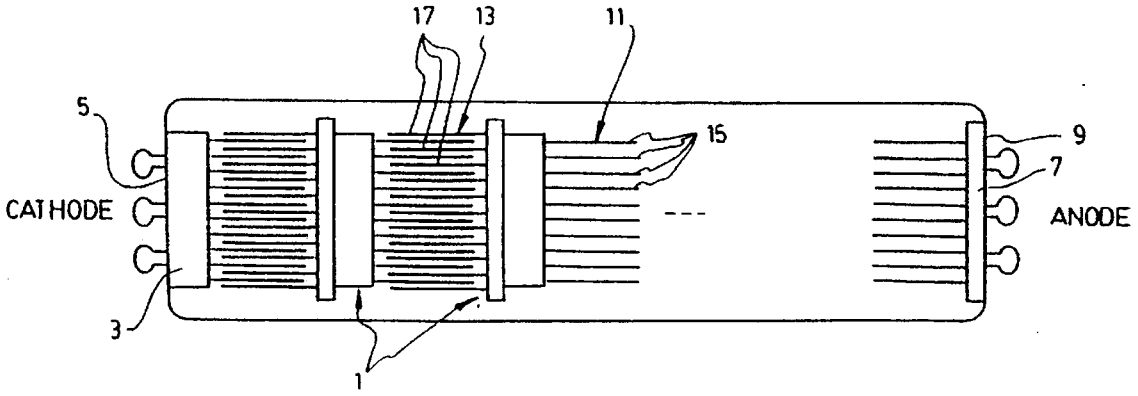
FIG. 1 (PRIOR ART)
FIG. 1 is a schematic top plan view of an electrolysis cell of conventional structure used for the electrochemical of sodium chlorate synthesis.

As indicated above, the cathodes produced with the alloy according the invention are very stable in the electrolyte solution used in electrolysis cells like the one illustrated in on FIG. 1. Table II hereafter gives the atomic percentages of Ti, Ru and Fe in an electrode made of alloy according to the invention, before and after 292 hours of operation in an electrolysis cell. As readily apparent, these atomic percentages measured by EDX spectography have almost not change in time.

Figure 9:
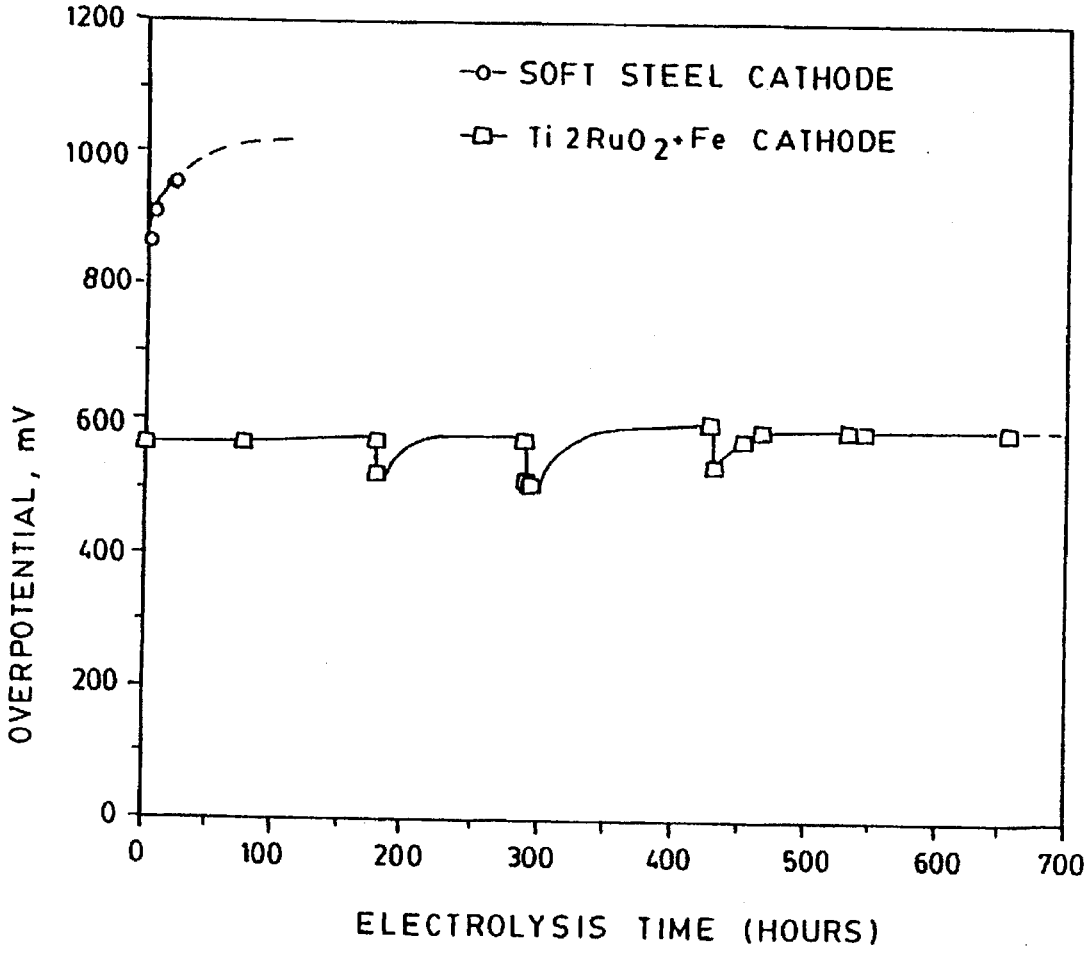
FIG. 9 is a diagram companying the overpotential of hydrogen measured on a soft steel cathode (o) and the one measured on a cathode made of the alloy whose X-ray diffraction spectrum is shown in FIG. 5 (□), during a period of more than 675 hours of electrolysis (1 month)

FIG. 9 shows also the evolution of the value of the over potential of hydrogen measured on a soft steel cathode (o) and a cathode (□) made of the alloy whose synthesis is illustrated in FIG. 4. These overpotentials were measured under a current of density of 250 mA/cm$^2$ at 70° C.

As it can be seen again, no apparent degradation was noted over a period of almost one month of operation (675 hours of electrolysis).

TABLE II

| | Ti (at. %) | Ru (at. %) | Fe (at. %) | Ti/Ru |
|---|---|---|---|---|
| Initial composition | 43.7 | 22.8 | 33.5 | 1.9 |
| 292 hours of electrolysis | 43.3 | 25.8 | 30.8 | 1.7 |

As can be noticed, the cathodes made from the alloy of the above mentioned formula permit to easily and simply improve the electric efficiency of the sodium chlorate synthesis cells. This improvement may typically range between 5 to 10 MW for a factory of 50 to 100 MW. These cathodes may thus generate annual savings of many millions of dollars.

The cathodes made from the alloy of the above mentioned formula are very efficient and resistant and moreover they are also easier to combine to the anodes of titanium, since they can be welded directly to this metal. In fact, the alloy may be applied on a titanium plate which may then be welded to the anode. Presently, the steel cathodes used in the industry can only be welded by explosion, which generates costs.

Furthermore, the cathodes made from the alloy of the above mentioned formula are extremely safe to use. In fact, it has been noted that the speed of decomposition of the hypochlorite in contact with the material forming the cathodes is very low. As a matter of fact, this speed is even lower than the speed measured on the steel electrodes, which means that there is very little molecular oxygen released. This reduces even more the risks of simultaneous release of molecular hydrogen and oxygen with all the inherent risks of explosion that such implies.

TABLE III

| Materials | Speed of Release of Oxygen |
|---|---|
| Alloy according to the invention | 1.09 |
| Iron (Fe 325 Mesh) | 1.23 |
| NiO (black) | 1.61 |
| $RuO_2$ | 2.20 |

Table III shows that among all the tested materials, the cathode made from the alloy according to the invention is the one that is the most inert to the decomposition of the hypochlorite.

Of course, minor modifications could be made to the invention as disclosed hereinabove, without departing from the scope of the present invention as defined in the enclosed claims.

We claim:

1. A nanocrystalline alloy of formula:

$$Ti_{30+x}Ru_{15+y}Fe_{25+z}O_{30+t}M_u$$

wherein:

M represents at least one metal selected from the group consisting of chromium, manganese, vanadium, tungsten, antimony, platinum and lead;

x is an integer ranging between −30 and +50;

y is an integer ranging between −10 and +35;

z is an integer ranging between −25 and +70;

t is an integer ranging between −28 and +10; and u is an integer ranging between 0 and +50;

with the proviso that x, y, z, t and u are selected so that:

x+y+z+t+u=0.

2. An alloy as defined in claim 1, wherein x is an integer ranging between −20 and +20;

y is an integer ranging between −10 and +15;

z is an integer ranging between −25 and +25;

t is an integer ranging between −28 and +5; and u is an integer ranging between 0 and +10.

3. An alloy as defined in claim 1, wherein x is an integer ranging between −5 and +5;

y is an integer ranging between −5 and +5;

z is an integer ranging between −5 and +5;

t is an integer ranging between −28 and +5; and u is an integer ranging between 0 and +10.

4. An alloy as defined in claim 1 wherein M is chromium.

5. A method for producing sodium chlorate by electrochemical synthesis, comprising the step of subjecting a solution of NaCl to electrolysis in an electrolysis cell containing at least one cathode made at least in part of an alloy of formula:

$$Ti_{30+x}Ru_{15+y}Fe_{25+z}O_{30+t}M_u$$

wherein:

M represent at least one metal Selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

x, y, z, t and u being selected so that:

x+y+z+t+u=0.

6. A method as defined in claim 5, wherein:

x is an integer ranging between −20 and +20;

y is an integer ranging between −10 and +15;

z is an integer ranging between −25 and +25;

t is an integer ranging between −28 and +5; and u being an integer ranging between 0 and +10.

7. A method as defined in claim 5, wherein:

x is an integer ranging between −5 and +5;

y is an integer ranging between −5 and +5;

z is an integer ranging between −5 and +5;

t is an integer ranging between −28 and +5; and u is an integer ranging between 0 and +10.

8. A method as defined in claim 5, wherein M is chromium.

9. A method as defined in claim 5, wherein the alloy has a nanocrystalline structure.

10. A method as defined in claim 7, wherein the alloy has a nanocrystalline structure.

11. A cathode for the electrochemical synthesis of sodium chlorate in am electrolyte solution, said cathode being very stable in the electrolytic solution used for the synthesis and nonreactive toward the decomposition of hypochlorite, wherein said cathode is made at least in part of an alloy of formula:

$$Ti_{30+x}Ru_{15+y}Fe_{25+z}O_{30+t}M_u$$

wherein:

M represent at least one metal selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

in which x, y, z, t and u being selected so that:

x+y+z+t+u=0.

12. A cathode as defined in claim 11, wherein:

x is an integer ranging between −20 and +20;

y is an integer ranging between −10 and +15;

z is an integer ranging between −25 and +25;

t is an integer ranging between −28 and +5; and u is an integer ranging between 0 and +10.

13. A cathode as defined in claim 11, wherein:

x is an integer ranging between −5 and +5;

y is an integer ranging between −5 and +5;

z is an integer ranging between −5 and +5;

t is an integer ranging between −28 and +5; and u is an integer ranging between 0 and +10.

14. A cathode as defined in claim 11, wherein M is chromium.

15. A cathode as defined in claim 11, wherein the alloy is nanocrystalline.

16. A cathode as defined in claim 12, wherein the alloy is nanocrystalline.

17. A cathode as defined in claim 13, wherein the alloy is nanocrystalline.

18. A method of making a cathode for the electrochemical synthesis of sodium chlorate in an electrolyte solution, said cathode being very stable in the electrolytic solution used for the synthesis and nonreactive toward the decomposition of hypochlorite, wherein said cathode is made at least in part of an alloy of formula:

$$Ti_{30+x}\,Ru_{15+y}\,Fe_{25+z}\,O_{30+t}\,M_u$$

wherein M represents at least one metal selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

in which x, y, z, t and u are selected so that:

$x+y+z+t+u=0$, which comprises the step of compacting a powder of said alloy.

19. A method of making a cathode as defined in claim 18, wherein said powder is compacted into a porous support.

20. A method of making a cathode for the electrochemical synthesis of sodium chlorate in an electrolyte solution, said cathode being very stable in the electrolytic solution used for the synthesis and nonreactive toward the decomposition of hypochlorite, wherein said cathode is made at least in part of an alloy of formula:

$$Ti_{30+x}\,Ru_{15+y}\,Fe_{25+z}\,O_{30+t}\,M_u$$

wherein M represents at least one metal selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

in which x, y, z, t and u are selected so that:

$x+y+z+t+u=0$, which comprises the step of plasma spraying a powder of said alloy onto a support.

21. A method of making a cathode for the electrochemical synthesis of sodium chlorate in an electrolyte solution, said cathode being very stable in the electrolytic solution used for the synthesis and nonreactive toward the decomposition of hypochlorite, wherein said cathode is made at least in part of an alloy of formula:

$$Ti_{30+x}\,Ru_{15+y}\,Fe_{25+z}\,O_{30+t}\,M_u$$

wherein M represents at least one metal selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

in which x, y, z, t and u are selected so that:

$x+y+z+t+u=0$, which comprises the step of electro-codepositing a powder of said alloy onto a support.

22. A method of making a cathode for the electrochemical synthesis of sodium chlorate in an electrolyte solution, said cathode being very stable in the electrolytic solution used for the synthesis and nonreactive toward the decomposition of hypochlorite, wherein said cathode is made at least in part of an alloy of formula:

$$Ti_{30+x}\,Ru_{15+y}\,Fe_{25+z}\,O_{30+t}\,M_u$$

wherein M represents at least one metal selected from the group consisting of chromium, manganese, vanadium, tungsten, antimony, platinum and lead, x is an integer ranging between −30 and +50;

y is an integer ranging between −10 and +35;

z is an integer ranging between −25 and +70;

t is an integer ranging between −28 and +10; and u is an integer ranging between 0 and +50;

in which x, y, z, t and u are selected so that:

$x+y+z+t+u=0$, which comprises the step of depositing said alloy in a vapor phase on a support.

23. A method of making a cathode as defined in claim 22, wherein the deposition in a vapor phase is carried out by magnetron spraying.

24. A method of making a cathode as defined in claim 22, wherein the deposition in a vapor phase is carried out by evaporation.

* * * * *

UNITED STATES PATENT AND TRADEMARK OFFICE

CERTIFICATE OF CORRECTION

PATENT NO. : 5,662,834

DATED : September 2, 1997

INVENTOR(S) : Thierry ORLHAC

It is certified that error appears in the above-identified patent and that said Letters Patent is hereby corrected as shown below:

"Abstract", lines 5-9, "integer" should read --number--.

In the Figures, Figure 5, "$Ti_{22}Fe_{37}Ru_{11}O_{33}$-40h(Ar)" should read --$Ti_{22}Fe_{37}Ru_{11}O_{30}$-40h(Ar)--.

Column 2, lines 53, 56, 59, 62 and 65, "integer" should read --number--.

Column 4, line 30, "$Ti_{22}Ru_{1}Fe_{37}O_{33}$" should read --$Ti_{22}Ru_{11}Fe_{37}O_{30}$--.

UNITED STATES PATENT AND TRADEMARK OFFICE

CERTIFICATE OF CORRECTION

PATENT NO. : 5,662,834

DATED : September 2, 1997

INVENTOR(S) : Thierry ORLHAC

It is certified that error appears in the above-identified patent and that said Letters Patent is hereby corrected as shown below:

Column 5, line 12, "integers" should read --numbers--.

Column 11, Claim 1, lines 34-38 "integer" should read --number--.

Column 11, Claim 2, lines 43-47, "integer" should read --number--.

Column 11, Claim 3, lines 49-53, "integer" should read --number--.

Column 12, Claim 5, lines 1-5, "integer" should read --number--.

UNITED STATES PATENT AND TRADEMARK OFFICE

CERTIFICATE OF CORRECTION

PATENT NO. : 5,662,834
DATED : September 2, 1997
INVENTOR(S) : Thierry ORLHAC

It is certified that error appears in the above-identified patent and that said Letters Patent is hereby corrected as shown below:

Column 12, Claim 6, lines 11-15, "integer" should read --number--.

Column 12, Claim 7, lines 17-21, "integer" should read --number--.

Column 12, Claim 11, line 43-47, "integer" should read --number--.

Column 12, Claim 12, lines 52-56, "integer" should read --number--.

Column 12, Claim 13, lines 58-62, "integer" should read --number--.

Column 13, Claim 18, lines 17-21, "integer" should read --number--.

UNITED STATES PATENT AND TRADEMARK OFFICE

CERTIFICATE OF CORRECTION

PATENT NO. : 5,662,834

DATED : September 2, 1997

INVENTOR(S) : Thierry ORLHAC

It is certified that error appears in the above-identified patent and that said Letters Patent is hereby corrected as shown below:

Column 13, Claim 20, lines 41-45, "integer" should read --number--.

Column 14, Claim 21, lines 11-15, "integer" should read --number--.

Column 14, Claim 22, lines 34-38, "integer" should read --number--.

Signed and Sealed this

Seventeenth Day of February, 1998

Bruce Lehman

*Attest:*

BRUCE LEHMAN

*Attesting Officer*

*Commissioner of Patents and Trademarks*